United States Patent [19]

Elliott

[11] Patent Number: 4,552,588

[45] Date of Patent: Nov. 12, 1985

[54] MAGNESIUM REDUCTION OF URANIUM FLUORIDE IN MOLTEN SALTS

[76] Inventor: Guy R. B. Elliott, 133 La Senda Rd, Los Alamos, N. Mex. 87544

[21] Appl. No.: 502,714

[22] Filed: Jun. 9, 1983

[51] Int. Cl.[4] ..... C22B 60/02

[52] U.S. Cl. ..... 75/84.4; 75/84.1 R; 75/84.1 A

[58] Field of Search ..... 75/84.1 R, 84.1 A, 84.4, 75/27, 89

[56] References Cited

U.S. PATENT DOCUMENTS 3,088,823 5/1963 Magoteaux ..... 75/84.1
4,295,884 10/1981 Hicter ..... 75/68 R

FOREIGN PATENT DOCUMENTS 804063 11/1958 United Kingdom ..... 75/84.1 R
804064 11/1958 United Kingdom ..... 75/84.1 R

*Primary Examiner*—Deborah L. Kyle
*Assistant Examiner*—Anne Brooks

[57] ABSTRACT

A method and apparatus are provided for reducing uranium fluoride with magnesium to form uranium metal or uranium alloys. The reduction is carried out in a molten-salt solution in which the metallic product sinks and separates while the magnesium fluoride by-product dissolves into the molten salt or forms a solid precipitate outside of the metallic region.

10 Claims, 5 Drawing Figures

MAGNESIUM REDUCTION OF URANIUM FLUORIDE IN MOLTEN SALTS

BACKGROUND OF THE INVENTION

This invention relates generally to a method and apparatus for reducing uranium fluoride by reaction with magnesium in a molten-salt medium, thereby generating uranium as bulk metal, the process being accomplished at pressures and temperatures lower than those usually employed in commercial reductions of uranium fluoride by magnesium in pressure-containment vessels; likewise, the present invention offers a means to carry out substantially continuous reductions. Both continuous operations and operations at reduced pressures and temperatures offer economic and engineering advantages over commercial practice and other prior art.

Definitions

In this disclosure, unless otherwise specified, the unrestricted term "uranium" is defined to include substantially metallic alloys comprising at least 50 percent by weight in total of isotopes of the element with the chemical symbol, U. As examples, "uranium" may refer to socalled depleted uranium, DU, to natural uranium as reduced from natural ore, or to alloys of such forms of the element, e.g., DU containing 7.5 weight percent of niobium. Likewise, "uranium fluoride" is defined to include substantially fluoride mixtures comprising at least 50 weight percent in total of one or more of the fluorides of isotopes of the element, U—together or alone, $UF_3$, $UF_4$, and $UF_6$ will be present in "uranium fluoride" under this definition to a total of at least 50 percent, impurities such as $UO_2$ may be present, and materials such as $Nb_2O_3$ or $NbF_5$ may be deliberately added to form desired alloys directly upon reduction; likewise, the content of U may involve any isotopes in any proportions.

As suggested above, most reductions of uranium fluoride to uranium are made by magnesium in pressure-containment vessels. For reactions to produce DU metal from $UF_4$ (where no nuclear-criticality hazard is involved), the reductions on commercial scale are usually carried out in large, sealed reaction vessels made of heavy-walled steel which is carbon lined inside and otherwise coated with relatively inert materials. Reaction charges as large as 0.7 tons of blended mixtures of powdered $UF_4$ and slightly more than enough magnesium to reduce all the $UF_4$ to metal are packed into the reaction vessels. These charges are tamped and covered with inert material, then sealed to withstand high pressures. Next, these sealed reaction vessels are placed in large furnaces and are heated to about 700° C. at which temperature the charge inside a vessel will ignite and generate high temperature and high pressure of magnesium vapor. If the ignition produces a successful reduction of the $UF_4$, the products of the reaction include molten uranium, molten $MgF_2$, and liquid and gaseous magnesium. The reaction vessels are cooled after ignition, the charge is dumped out, and $MgF_2$ is broken off the billet of metallic DU. Metallic DU is later moved to a different heating unit and is remelted and alloyed. The $MgF_2$ waste contains small amounts of uranium, primarily as $UF_3$ and $UO_2$, so the $MgF_2$ must be shipped to central burial sites for radioactive materials.

Numerous things can go wrong with current reductions of $UF_4$ as just described: (1) Handling $UF_4$ in open rooms creates personnel and environmental hazards involving escape of the slightly radioactive dust. (2) Magnesium powder has some chance of igniting if it is sparked. (3) If the reaction vessel does not seal properly, flammable magnesium vapor mixed with $UF_4$ dust can be released. (4) Moisture adsorbed onto the $UF_4$ powder can form $UO_2$ which reacts poorly at best, also CO which adds undesirable carbon to the metallic product, plus HF which coats the magnesium powder and may retard the reduction reaction, and other products which are unwanted. (5) Improperly coated carbon liners can introduce carbon into the metallic product. (6) Cracked carbon liners can permit the metallic DU to attack the steel and melt holes in it by forming low-melting, iron-uranium alloy. (7) Leaky vessels can lead to loss of magnesium and incomplete reaction. (8) $MgF_2$ can be trapped inside the billet. (9) Metallic uranium dispersed in the cooled $MgF_2$ can ignite magnesium-vapor condensate when exposed to air. As corollary to all the aforementioned problems with current reduction practice, there is need for new concepts in reduction as presented by the invention described here.

The problems just discussed are substantially a consequence of designing the system to retain magnesium vapor pressures far higher than atmospheric, i.e., at transient temperatures which will assure melting of both uranium and the magnesium fluoride products of the reduction reaction. Thus the magnesium vapor pressures, following current operating procedures, can rise to several hundred pounds per square inch in a routine reduction, and these pressures exhibit variability, depending upon the way ignition of the reduction takes place, i.e., temperature, time, location, etc.

The present invention avoids the high pressures just mentioned by carrying out the reactions at much lower temperatures in a molten-salt bath which is substantially unreactive except that it dissolves magnesium, thereby reducing the magnesium vapor pressure relative to what it would have been for pure magnesium at the same temperature. Likewise, to keep temperatures and pressures down, the $MgF_2$ product may be generated in solution in molten salt rather than at the melting point of pure $MgF_2$ which melts about 128° C. higher than uranium. Finally, the molten-salt bath may be operated in a temperature gradient with its surface regions below the boiling point of magnesium (about 1090°) where the $UF_4$ reductions take place; then the solid uranium is allowed to sink to a warmer region where it melts (about 1133°), coalesces, and may form a trap to pass uranium but hold molten salt, as will be discussed further.

Further advantages of the present invention over current practice are: (1) relatively small amounts of $UF_4$ are handled at any time, so the work can be done in a well-contained, protected, dry, inert environment, (2) only small amounts of magnesium powder need be used at any time, and the atmosphere can be inert, (3) the reaction can be carried out substantially at atmospheric pressure, (4) moisture either is not absorbed by the $UF_4$, or the moisture can be removed before the reduction reaction takes place, (5) carbon liners are not used, (6) container steel is not used, (7) leaky vessels and escape of $UF_4$ and magnesium vapor are avoided or can be more readily controlled than under current practice, (8) because the phase separations are slow and continuous, there is little chance that $MgF_2$ will be trapped in the uranium, (9) uranium has little chance of becoming entrapped in the waste $MgF_2$, and (10) dissolution or suspension of $UO_2$ or $UF_3$ in the molten-salt waste is anticipated to be minimal.

The process depends upon, first, choosing chemicals which are either inert or yield desired chemical reactions, second, have suitable melting points, third, have proper solubilities or immiscibilities, and, fourth, have densities which will cause the reactants and products of the reactions to move (by gravity or by mechanical action) in the right directions. In this way the process can be designed to be capable of substantially continuous operation, with streams of uranium product and $MgF_2$-containing waste being cleanly separated as they move out of the reduction system.

In selection of the process chemistry, the usual reaction of $UF_4$ with magnesium is accepted as the principal reaction. (But see uranium-fluoride definition given earlier regarding impurities and possible additives such as those for direct alloying.) The reaction is expected to take place in two steps:

$$2UF_4+Mg=2UF_3+MgF_2 \quad (1)$$

$$2UF_3+3Mg=2U+3MgF_2 \quad (2)$$

or, if the reactions are combined:

$$UF_4+2Mg=U+2MgF_2 \quad (3)$$

(If an additive such as $Nb_2O_3$ is present, it, too, will be reduced by the magnesium:

$$Nb_2O_3+3Mg=2Nb+3MgO \quad (4)$$

where the Nb is alloyed with the U formed by reaction 3. Such coreduction is expected to result in large savings, because pure niobium is very expensive to buy alone, e.g., $60 per pound, and because the alloying process involves an expensive remelting of the reduction product, in current technology.)

Depending upon the content of the uranium fluoride and upon other factors, including economic factors, any of several halides of the alkali and alkaline earth metals may be selected to produce eutectic lowering of the melting point of the $MgF_2$. Thus, $BaF_2$ is probably a good solvent for magnesium, and the $BaF_2$ can be recovered for recycle by dissolution in water; $CaCl_2$ is cheap and easy to recover for recycle, but it perhaps will introduce significant impurities for some uses; NaF may be useful if the liquid compound $MgF_2$.NaF is present to stabilize the NaF. Similar lines of reasoning can be given for other alkali and alkaline earth halides.

To hold the magnesium and uranium fluoride reactants together, and to sink the light magnesium into the melt, compacts such as pellets are added to the molten-salt region in which the reactions take place. Technology for forming such pellets is known to those versed in the art. An excess of magnesium is maintained in the molten-salt region, as dissolved magnesium, so that (a) uranium recovery will be high, and (b) radioactive contamination in the $MgF_2$ by-product will be low, thereby reducing disposal problems.

Because the vapor pressure of magnesium is greater than one atmosphere at the melting point of uranium, one or more of four concepts is employed to reduce magnesium vaporization: First, a temperature gradient in the molten-salt region may be employed so that solid uranium may be formed at temperatures below the melting point of uranium and below the boiling point of magnesium, with the solid uranium subsequently sinking into hotter locations in the molten-salt region and melting there. Second, dissolving magnesium into molten salt will lower the magnesium vapor pressure relative to that of pure magnesium at the same temperature. Third, vaporized magnesium may be condensed and fed back to the molten-salt region. Fourth, the system may be operated pressurized to pressures slightly greater than atmospheric, e.g., by a column of molten salt or by a low-pressure containment vessel.

Molten uranium may be used as a trap to retain molten salt but pass molten uranium. This concept is discussed further in the description of the drawings.

Prior art in $UF_4$/Mg reductions offers neither continuous processing nor operations to produce molten metal at low pressure. The need for the invention is demonstrated by the high cost and rate of failures of the current reduction practice in forming substantially pure uranium from $UF_4$ and by the environmental and personnel hazards in current practice.

SUMMARY OF THE INVENTION

An object of this invention is a method of reducing uranium fluoride to uranium by reaction with magnesium at near-atmospheric pressure.

A further object of this invention is compositions of molten salts suitable for carrying out reductions of uranium fluoride to uranium by reaction with magnesium at near-atmospheric pressure.

A still further object of this invention is methods of establishing near-atmospheric pressures of magnesium during reductions of uranium fluoride.

A still further object of this invention is the introduction of magnesium and uranium fluoride into a molten-salt region.

A still further object of this invention is maintenance of compositions in a molten-salt region.

A still further object of this invention is an apparatus for reacting uranium fluoride with magnesium to produce uranium.

Additional objects, advantages, and novel features of the invention will be set forth in part in the descriptions which follow, and in part will become apparent to those skilled in the art upon examination of the following or may be learned by practice of the invention. The objects and advantages of the invention may be realized and attained by means of instrumentalities and combinations particularly pointed out in the appended claims. To achieve the foregoing and other objects, and in accordance with the purpose of the present invention, as embodied and broadly described herein, the method of the invention comprises:

- providing a means for heating and containing molten salt,
- providing a substantially inert atmosphere within the said means for heating and containing molten salt,
- emplacing molten salt in the said means for heating and containing molten salt, thereby creating a molten-salt region,
- introducing uranium fluoride and magnesium into the said molten-salt region,
- allowing the said reaction of uranium fluoride with magnesium to take place.
- allowing the said uranium produced by the said reaction of uranium fluoride with magnesium to settle from the said molten salt, and independently removing the said uranium and the magnesium-fluoride byproduct of the said reaction of uranium fluoride with magnesium.

In a preferred embodiment, the reactants which form uranium, i.e., uranium fluoride and magnesium (in this case shown as compacts in the form of pellets) are dropped into a molten-salt region where the uranium product forms and settles into a molten-uranium region, and magnesium fluoride product dissolves into molten salt or forms a solid which can float on the molten salt.

In another preferred embodiment, compacts of uranium fluoride, magnesium, and $BaF_2$ are dropped into a molten-salt region of uniform temperature where uranium product settles into a molten-uranium region and displaces excess molten uranium into a billet mold; meanwhile, excess molten salt is displaced from its region and into a waste collector. Preferably, the molten salt has a eutectic temperature at least as low as 1150° C.

In another preferred embodiment, compacts of uranium fluoride, magnesium, and $BaF_2$ are dropped into a molten-salt region with cooled upper-surface area in which solid uranium product is formed, falls into a hotter area where it melts, and further falls into a molten-uranium region from which it displaces excess molten-uranium into a billet mold.

In another preferred embodiment, a condenser for trapping magnesium and dropping it to a return system is used to supply stirrers which pump magnesium into a molten-salt region where uranium fluoride is reduced.

In a final preferred embodiment, reactive compacts fall through magnesium floating on a molten-salt region.

In a still further aspect of the present invention in accordance with its objects and purposes, the apparatus of the invention comprises:

a first containment means with at least one first entry means and, at lower elevation, at least one first discharge means, molten uranium filling the said first containment means to the discharge elevation of the said first discharge means, a second containment means with at least one second entry means and, at lower elevation, at least one second discharge means, the said second discharge means being positioned within the said molten uranium and at an elevation lower than the elevation of the said first discharge means, and the said second entry means being positioned at a higher elevation than the said molten uranium, molten salt both at least partially filling the said second containment means and floating upon the said molten uranium, a means for introducing at least uranium fluoride and magnesium through the said second entry means and into the said molten salt, a means for collecting molten uranium which has formed in the said molten salt, has moved from the said molten salt, and has passed into the said molten uranium, thereby passing through the said second discharge means and through the said first entry means, a means for discharging at least magnesium fluoride separate from the said first discharge means, and a means for providing an inert atmosphere in regions where reactants, i.e., uranium fluoride and magnesium, and the uranium product of the reaction could be attacked by a reactive atmosphere.

BRIEF DESCRIPTION OF THE DRAWINGS

The accompanying drawings, which are incorporated in and form a part of the specification, illustrate various embodiments of the present invention and, together with the description, serve to explain the principals of the invention. In the drawings.

DESCRIPTION OF THE PREFERRED EMBODIMENTS

Figure 1:
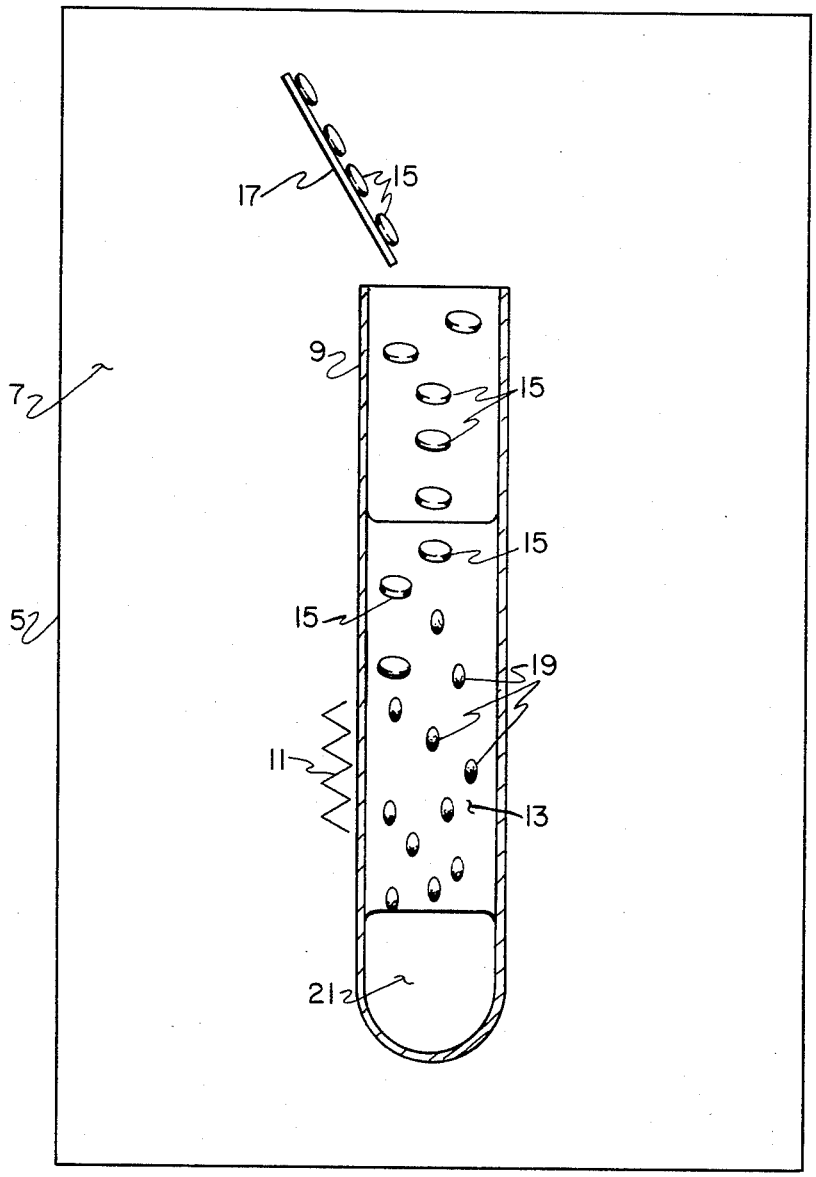
FIG. 1 is a schematic illustration in cross section of an embodiment of an apparatus demonstrating the method of the invention showing pellets of uranium fluoride together with magnesium dropping into a molten-salt region where the uranium product forms and settles into a molten-uranium region, and magnesium-fluoride product dissolves into molten salt or floats.

Among the preferred embodiments, FIG. 1 shows a glove box 5 with inert atmosphere 7 holding an inert-ceramic container 9 and heater 11. Within the inert-ceramic container 9, there is a molten-salt region 13 into which reactive compacts 15 fall as delivered by feeder 17. The molten-salt region 13 may vary in composition from about 60 mole percent of $BaF_2$ with $MgF_2$ and various impurities to about 40 mole percent of $BaF_2$. The compacts may be stoichiometric mixtures of $UF_4$ and magnesium, they may contain compounds or metals of alloying elements, they may contain $BaF_2$, and they may contain other additives. These compacts 15 are shown reacting and forming molten uranium droplets 19 which fall into a molten-uranium region 21. Periodically, excess molten-salt-region material and molten-uranium-region material are removed, e.g., by ladling. Solid $MgF_2$ may be floating on the molten salt.

FIG. 2 again shows the glove box 5 with inert atmosphere 7. In this case the inert container 9 has been replaced by second inert container 29 which has an open bottom and by third inert container 31 which is shaped like a chemical beaker. Third inert container 31 holds molten uranium 33 which acts as a trap to hold up the molten-salt region 13. Again reactive compacts 15 are fed by feeder 17, and these compacts produce molten uranium droplets 19 which fall through molten salt-molten uranium interface 35, thereby forcing excess uranium out of the container lip 37. Droplets of excess uranium 39 fall and form a billet 41 of uranium in billet mold 43. Excess molten salt 45, perhaps with $MgF_2$ solid, discharge to waste container 47. The system is heated by heaters 11; the furnace insulation is not shown, but the technology of heating and insulating furnaces is known to those versed in the arts.

Figure 2:
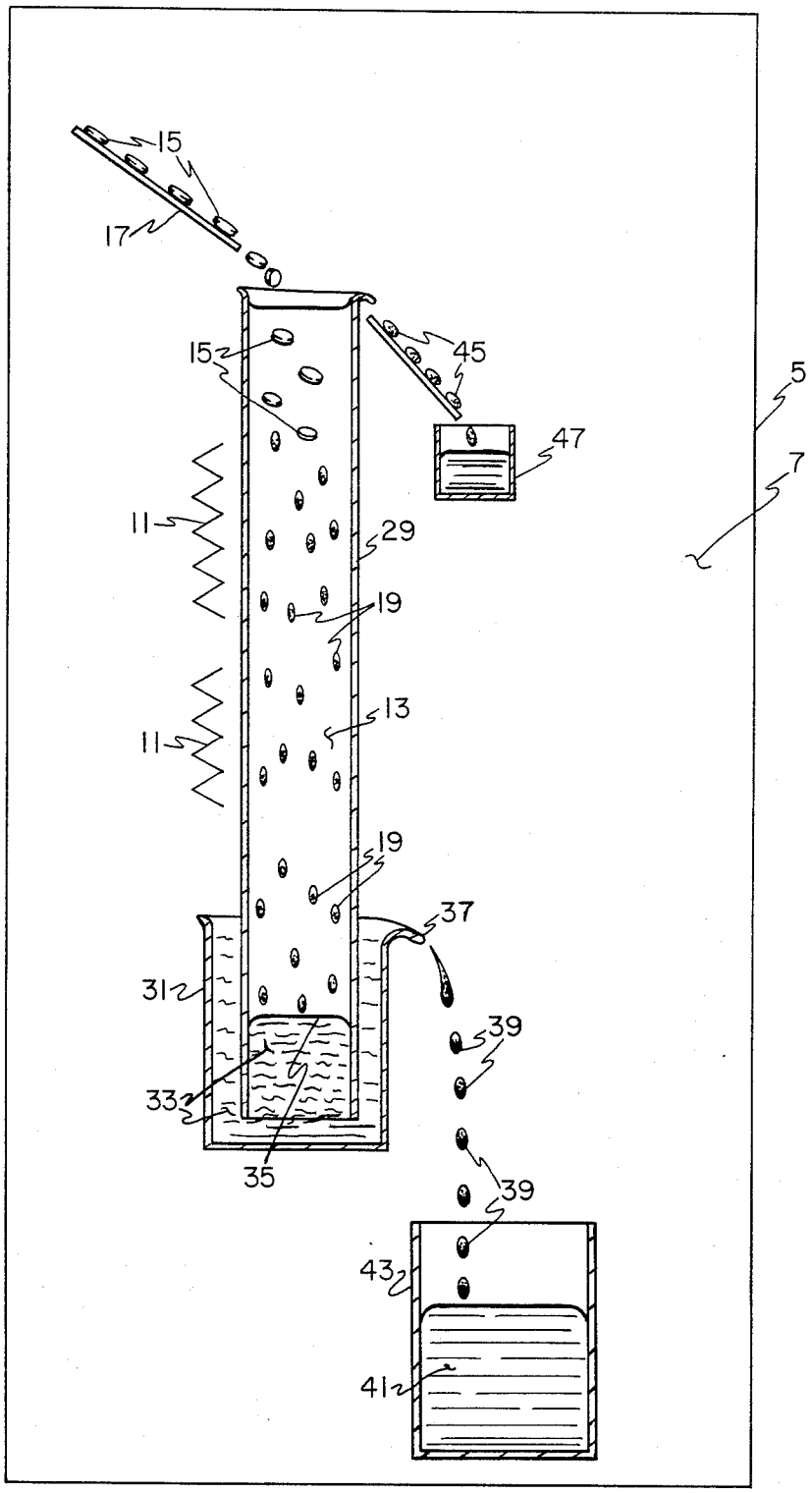
FIG. 2 is a schematic illustration in cross section of an embodiment of an apparatus demonstrating the addition of pellets containing uranium fluoride, magnesium, and $BaF_2$ into a molten-salt region of uniform temperature above the melting point of uranium where molten-uranium reaction product settles into a molten-uranium region and displaces excess molten uranium into a billet mold; meanwhile, excess molten salt is displaced from its region and into a waste collector. The density of both solid and molten uranium in all cases is greater than the density of molten salts.
Figure 3:
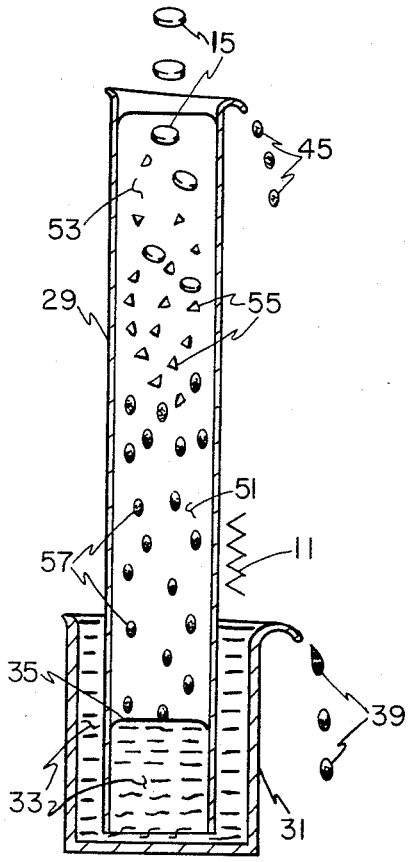
FIG. 3 is a schematic illustration in cross section of an embodiment of an apparatus demonstrating the addition of pellets containing uranium fluoride, magnesium, and $BaF_2$ into a molten-salt region with cooled upper-surface area in which solid-uranium reaction product is formed, falls into a hotter area where the solid uranium melts, then falls further into a molten-uranium region from which it displaces excess molten uranium into a billet mold, which mold is not shown.

FIG. 3 shows the same second inert container 29, the same third inert container 31, and the same molten uranium 33 acting as a trap, all as in FIG. 2. However, the molten salt region is now divided into two parts, a hot molten-salt region 51 and a cooler molten-salt region 53, the latter region being below the melting temperature of uranium. Reactive compacts 15 now fall into the cooler molten-salt region, form small crystals of solid uranium 55 which sink and form molten-uranium droplets of small size 57 which sink, cross the molten salt-molten uranium interface 35, and displace droplets of excess uranium 39. Excess molten salt 45 is discharged out the top. Heating is primarily by lower-position heaters as indicated by heater 11.

Figure 4:
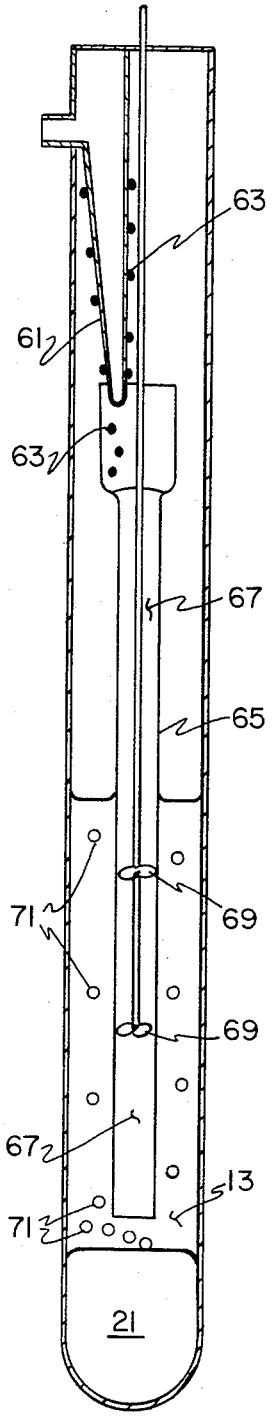
FIG. 4 is a schematic illustration in cross section of of a molten-salt region with magnesium condenser above for returning magnesium which has vaporized, the magnesium being returned deep within the molten-salt region by stirrers.

FIG. 4 shows the system of FIG. 1 adapted for return of vaporized magnesium. A condenser 61, such as a heat pipe or a metal rod, condenses molten magnesium 63 which drips into a tube 65 which holds a column of molten magnesium 67 and stirrers 69. Operating the stirrers drives magnesium droplets 71 ( or bubbles of magnesium vapor) into the molten-salt region 13 where the magnesium enters solution or reacts with uranium fluoride (not shown). Magnesium which does not dissolve recycles to the condenser 61.

Figure 5:
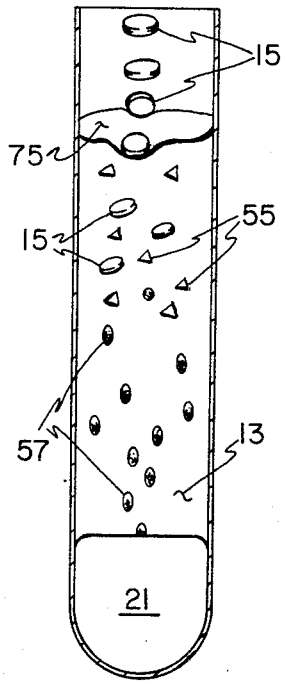
FIG. 5 is a schematic illustration in cross section of molten magnesium floating on molten salt so that reactive compacts must fall through magnesium before they enter a molten-salt region.

FIG. 5 again shows the system of FIG. 1 with cooled upper region holding molten magnesium 75. Reactive compacts 15 or other forms of reactants fall through the molten magnesium 75 and start reaction before they reach the molten-salt region 13. The first uranium to form is small crystals of solid uranium 55 which sink and form molten-uranium droplets of small size 57 which sink into the molten-uranium region 21.

What is claimed is:

1. A method of reducing uranium fluoride to uranium by reaction with magnesium at near-atmospheric pressure comprising:

(a) providing a means for heating and containing molten salt, (b) providing a substantially inert atmosphere within the said means for heating and containing molten salt, (c) emplacing molten salt in the said means for heating and containing molten salt, thereby creating a molten-salt region, (d) introducing uranium fluoride and magnesium into the said molten-salt region, (e) allowing the said reaction of uranium fluoride with magnesium to take place, (f) allowing the said uranium produced by the said reaction of uranium fluoride with magnesium to settle from the said molten salt, and (g) independently removing the said uranium and the magnesium-fluoride byproduct of the said reaction of uranium fluoride with magnesium.

2. A method according to claim 1 in which the composition of the said molten salt comprises at least 50 percent by weight of halides of alkali metals, of alkaline earth metals, or of both.

3. A method according to claim 1 in which at least the top portion of the said molten-salt region is held at temperatures below the melting point of uranium.

4. A method according to claim 1 in which the said uranium fluoride and the said magnesium dissolve at least partially in the said molten salt.

5. A method according to claim 1 in which the said molten salt has a eutectic temperature at least as low as 1150° C.

6. A method according to claim 1 in which the composition of the said molten salt is maintained substantially constant by additions of components of the said molten salt, thereby compensating for additions of magnesium fluoride introduced by the said reaction of uranium fluoride with magnesium.

7. A method according to claim 1 in which the said molten salt, being of density less than molten uranium, floats on molten uranium held in such configuration that the said molten salt acts as a trap to retain molten salt but pass molten uranium.

8. A method according to claim 1 in which at least some of the said uranium fluoride, the said magnesium, are added as compacts.

9. A method according to claim 1 in which magnesium vaporized from the said molten-salt region is condensed and returned to the said molten-salt region.

10. An apparatus for reacting uranium fluoride with magnesium to produce uranium comprising:

(a) a first containment means with at least one first entry means and, at lower elevation, at least one first discharge means, (b) molten uranium filling the said first containment means to the discharge elevation of the said first discharge means, (c) a second containment means with at least one second entry means and, at lower elevation, at least one second discharge means, the said second discharge means being positioned within the said molten uranium and at an elevation lower than the elevation of the said first discharge means, and the said second entry means being positioned at a higher elevation than the said molten uranium, (d) molten salt bath at least partially filling the said second containment means and floating upon the said molten uranium, (e) a means for introducing at least uranium fluoride and magnesium through the said second entry means and into the said molten salt, (f) a means for collecting molten uranium which has formed in the said molten salt, has moved from the said molten salt, and has passed into the said molten uranium, thereby passing through the said second discharge means and through the said first entry means, (g) a means for discharging at least magnesium fluoride separate from the said first discharge means, and (h) a means for providing an inert atmosphere in regions where the reactants, uranium fluoride and magnesium, and the uranium product of the reaction could be attacked by a reactive atmosphere.

* * * * *